US007255167B2

(12) United States Patent
Cognata

(10) Patent No.: US 7,255,167 B2
(45) Date of Patent: Aug. 14, 2007

(54) THREE PHASE DOWNHOLE SEPARATOR PROCESS

(76) Inventor: Louis John Cognata, 15002 Lakeview Dr., Baytown, TX (US) 77520

( * ) Notice: Subject to any disclaimer, the term of this patent is extended or adjusted under 35 U.S.C. 154(b) by 65 days.

(21) Appl. No.: 11/140,305

(22) Filed: May 31, 2005

(65) Prior Publication Data

US 2006/0027362 A1 Feb. 9, 2006

Related U.S. Application Data

(60) Provisional application No. 60/598,471, filed on Aug. 3, 2004.

(51) Int. Cl.
*E21B 43/38* (2006.01)
*E21B 43/40* (2006.01)

(52) U.S. Cl. ..... 166/265; 166/105.5; 166/106

(58) Field of Classification Search ..... 166/265, 166/105.5, 106, 266
See application file for complete search history.

(56) References Cited

U.S. PATENT DOCUMENTS 6,138,758 A * 10/2000 Shaw et al. ..... 166/265

OTHER PUBLICATIONS

John A. Vell & John J. Quinn, Downhole Separation Technology Performance: Relationship to Geologic Conditions, U.S. Department of Energy National Energy Technology Laboratory. Nov. 2004, Contract W-31-109-Eng 38.

* cited by examiner

*Primary Examiner*—David Bagnell
*Assistant Examiner*—Giovanna Collins
(74) *Attorney, Agent, or Firm*—Jackson Walker L.L.P.

(57) ABSTRACT

Three Phase Downhole Separator Process (TPDSP) is a process which results in the separation of all three phases, (1) oil, (2) gas, and (3) water, at the downhole location in the well bore, water disposal injection downhole, and oil and gas production uphole.

8 Claims, 1 Drawing Sheet

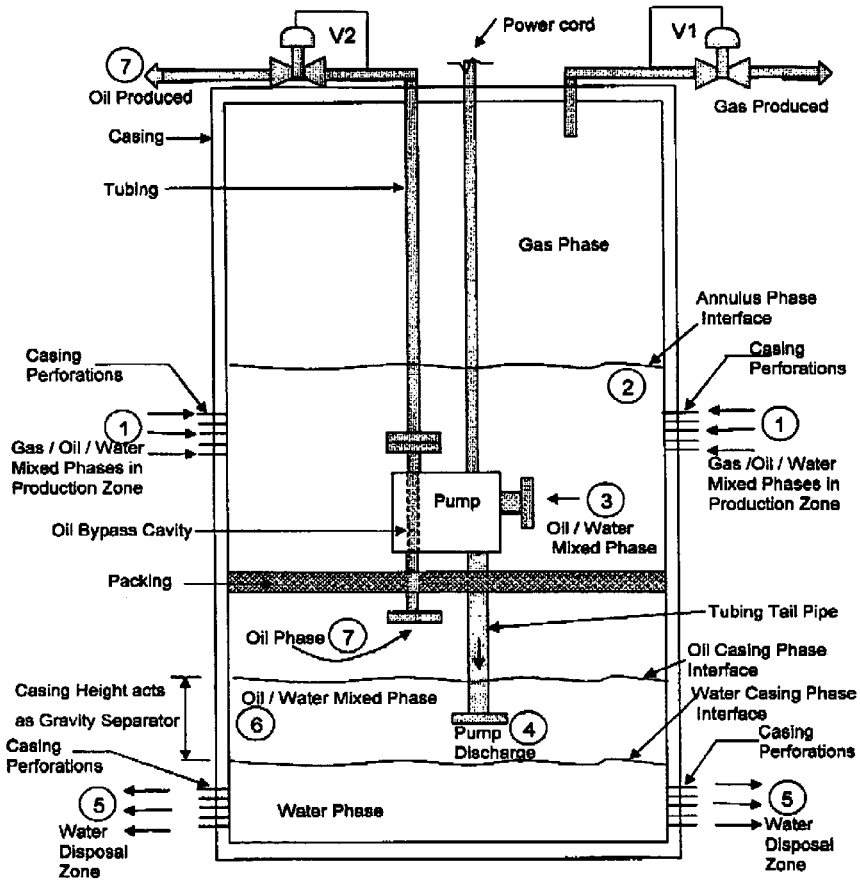

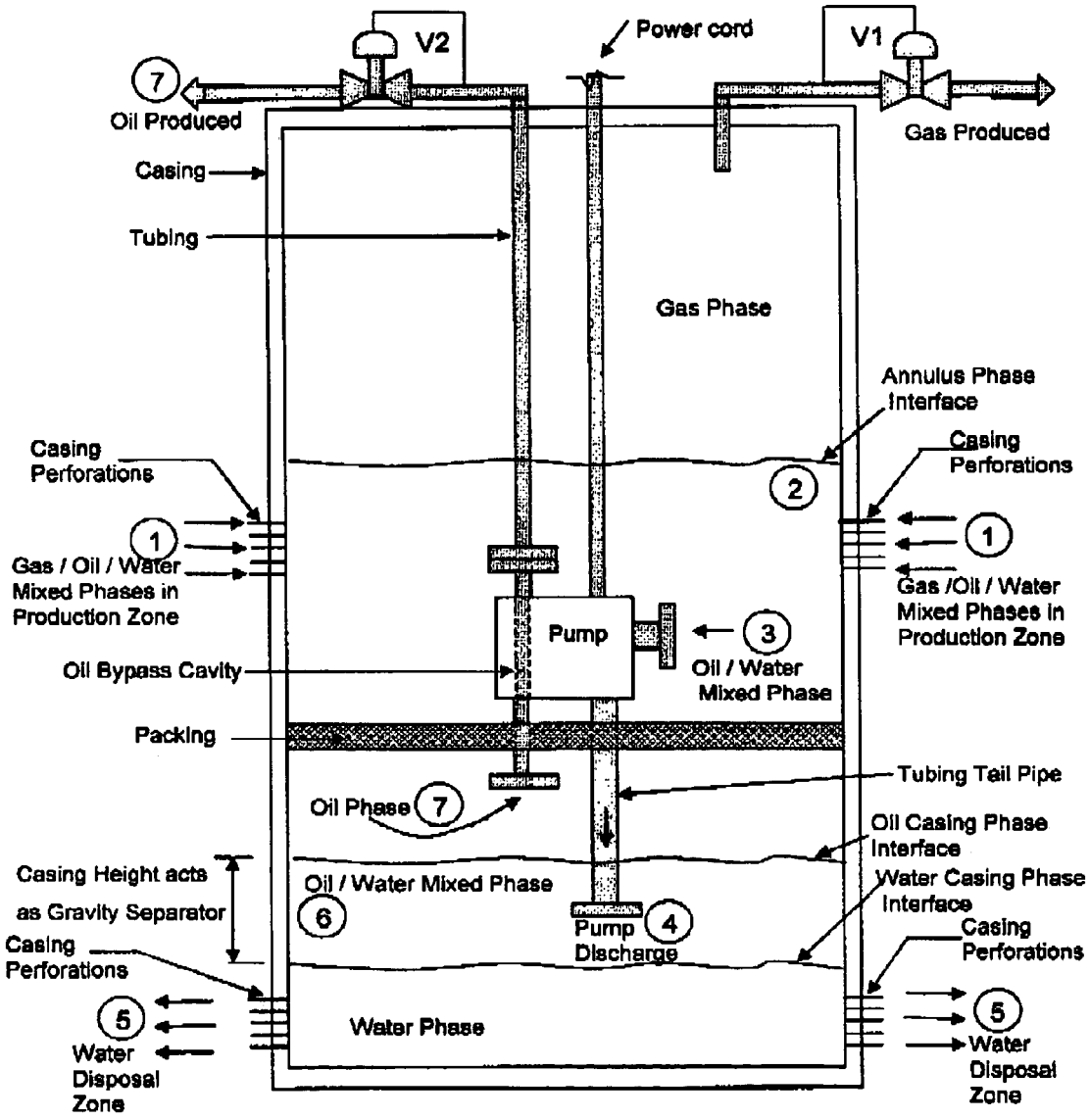
V2
Power cord
V1
7
Oil Produced
Gas Produced
Casing
Tubing
Gas Phase
Annulus Phase Interface
Casing Perforations
2
Casing Perforations
1
1
Gas / Oil / Water Mixed Phases in Production Zone
Gas /Oil / Water Mixed Phases in Production Zone
Pump
3
Oil / Water Mixed Phase
Oil Bypass Cavity
Packing
Tubing Tail Pipe
Oil Phase 7
Oil Casing Phase Interface
Casing Height acts as Gravity Separator
Oil / Water Mixed Phase
6
Water Casing Phase Interface
Pump Discharge 4
Casing Perforations
Casing Perforations
5
Water Phase
5
Water Disposal Zone
Water Disposal Zone

THREE PHASE DOWNHOLE SEPARATOR PROCESS

Three Phase Downhole Separator Process App No. 60/598,471 filed Aug. 3, 2004

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

The field of endevor is the Oil and Gas Production Industry. Reference Downhole Separation Technology Performance: Relationship to Geologic Conditions prepared for U.S. Department of Energy National Energy Technology Laboratory Under Contract W-31-109-Eng-38, Prepared by John A. Vell and John J. Quinn Argonne National Laboratory November 2004. This reference provides no method of separating three phases downhole.

BRIEF SUMMARY OF THE INVENTION

This invention provides the process method of separating three phases downhole: oil, water, and gas.

BRIEF DESCRIPTION OF THE DRAWING

One drawing is attached and entitled Three Phase Downhole Separator Process-ESP. This drawing shows the process wherein oil, gas, and water are separated downhole with electric submersible pump (ESP). Other types of pumps may also utilize Three Phase Downhole Separator Process.

DETAILED DESCRIPTION OF THE INVENTION

The Three Phase Downhole Separator Process (TPDSP) is a PROCESS which results in the separation of all three phases, ie, (1) oil, (2) gas, and (3) water, at the downhole location in the well bore, often one mile below the surface of the earth. TPDSP utilizes the four types of published standard oil industry Down Hole Gas Water Separation (DGWS) technology, (A) Electric Submersible Pumps (ESPs) (B) Modified Plunger Rod Pumps (MPRPs) (C) Bypass Tools and (D) Progressive Cavity Pumps. Each of these four published technologies are two-phase separation technologies, separating the gas phase from the water phase only. TPDSP improves over the published technologies because the published technologies provide only two phase downhole separation.

The TPDSP process converts each of the four published DGWS technologies into three-phase separator technologies. TDPSP (1) produces oil as a separate production stream uphole (2) produces gas as a separate production stream uphole and (3) injects water to the disposal zone downhole. TPDSP is not specific or limited to any one of the four published DGWS technologies nor is TPDSP based upon any one company's technology.

The TPDSP invention is a PROCESS patent, not a machine patent nor a manufacture patent nor composition of matter patent. It is a PROCESS patent because the invention provides for flow streams which are arranged differently than any previous patent or commercial idea, resulting in the separation of all three phases, ie, (1) oil, (2) gas, and (3) water at the downhole location. The category of the patent is UTILITY, not design nor plant.

Description of drawing which shows conversion of the DGWS Technology (A) Electric Submersible Pump: Refer to the drawing entitled, "THREE PHASE DOWNHOLE SEPARATOR PROCESS—ESP". This drawing shows conversion of the published DGWS technology (A) Electric Submersible Pump (ESP) into TPDSP. The PROCESS is described as the following streams:

| Stream Number | Stream Description |
|---|---|
| 1. | Gas, Oil, and Water flow from the formation through the casing perforations and into the casing annulus. |
| 2. | Gas bubbles upward thru the liquid oil and water mixture, and gas flows up the annulus to be produced at the surface. V1 is a back pressure regulator which is set at the proper pressure to assure that the Annulus Phase Interface location (API) stays above the ESP Pump Suction location. |
| 3. | Water/Oil mixture flows into the ESP Pump Suction as a liquid mixture. |
| 4. | High pressure liquid water/oil mixture flows downward out the Tubing Tail Pipe at the bottom ESP Pump Discharge. |
| 5. | High pressure liquid water continues flowing downward in the casing because water is more dense than oil. When the dense water falls and reaches the Water Casing Phase Interface (WCPI), the water is "pure" without oil bubbles. The liquid water flows into the Disposal Zone Casing Perforations and enters the disposal zone. [The Disposal Zone Casing Perforations must be sized small enough to provide a high enough back pressure to produce the oil to the surface, large enough to flow all the disposal water into the disposal zone, and placed at low enough depth to allow enough height for gravity separation of the oil and water phases.] |
| 6. | High pressure liquid oil "bubbles" upward thru the high pressure liquid water. The "bubbles" of oil become more and more numerous as they rise until they finally reach the Oil Casing Phase Interface (OCPI). Above OCPI is pure liquid oil. |
| 7. | High pressure oil flows thru the ESP pump Oil Bypass Cavity, up into the tubing, and to the surface thru V2. V2 is a back pressure regulator which is set at the proper pressure to assure that the OCPI stays below the Oil Bypass Cavity in the ESP. |

Although the drawing shows an electric submersible pump (ESP), the ESP on the drawing can be replaced by any one of the four published Down Hole Gas Water Separation (DGWS) technologies, (A) Electric Submersible Pumps (ESPs) (B) Modified Plunger Rod Pumps (MPRPs) (C) Bypass Tools and (D) Progressive Cavity Pumps. The result is TPDSP, a PROCESS which (1) produces oil as a separate production stream uphole (2) produces gas as a separate production stream uphole and (3) injects water to the disposal zone downhole.

TPDSP Applicablility to Unpublished and Future DGWS Technology: The TPDSP Process is applicable to the four published DGWS technologies, and in addition is applicable to unpublished and future DGWS technologies. For example, the downhole jet pump technology is a candidate for future DGWS technology, If the jet pump becomes a DGWS technology, this TPDSP Process could convert the DGWS jet pump technology to (1) produce oil as a separate production stream uphole (2) produce gas as a separate production stream uphole and (3) inject water to the disposal zone downhole.

The TPDSP Process applied to the four published DGWS technologies and to unpublished future DGWS technologies provides three phase separation downhole, water injection downhole, and both gas and oil production uphole.

The invention claimed is:

1. A downhole three phase separation process within a well-bore for processing water, oil, and gas phases in three separate streams and injecting of the water downhole, and providing the oil and gas as two separate streams up-hole comprising:

a) extending a casing into a formation of a well-bore and penetrating the casing;

b) allowing oil, gas or water to flow from the formation into an annulus of the casing and wherein the casing is of sufficient length to allow separation of the gas, oil and water;

c) forming a gas liquid interface within the annulus;

d) installing a pump comprising an oil bypass cavity below the gas liquid interface wherein the pump can provide a downward discharge;

e) providing a back pressure regulator for gas wherein the gas regulator controls back pressure to maintain the gas liquid interface above the pump; and f) providing a tubing back pressure regulator for oil.

2. The method of claim 1 wherein the pump comprises an electric submersible pump.

3. The method of claim 1 wherein the pump comprises a modified plunger rod pump.

4. The method of claim 1 wherein the pump comprises a progressive cavity pump.

5. A downhole three phase separation process within a well-bore extending from a surface for processing water, oil, and gas into three separate streams so as to inject the water downhole, and provide the oil and gas as two separate streams uphole comprising:

extending a casing into an oil, gas and water formation of a well-bore, the casing having a casing annulus;

perforating the casing so that the oil, gas and water may flow into the casing from the formation;

allowing a gas-liquid interface to form within a first vertical length of the casing annulus;

providing a pump below the gas-liquid interface wherein the pump can provide a downward liquid discharge;

providing a packing within the annulus below the pump wherein the packing is penetrated by a pump discharge pipe and by an oil bypass tubing;

allowing an oil phase to form within a second vertical length of the casing annulus;

allowing a water phase to form within the second vertical length of the casing annulus;

providing an oil bypass cavity in the pump wherein the oil bypass cavity routes the oil through the pump to an upper tubing;

providing a gas annulus back pressure regulator wherein the gas annulus back pressure regulator controls a back pressure to maintain the gas-liquid interface above the pump;

providing an oil tubing back pressure regulator for the oil wherein the oil tubing back pressure regulator controls back pressure so as to produce oil to the surface and to produce water to the discharge zone to maintain the oil water phase interface; and perforating the casing below the water-oil interface and sizing a plurality of perforation orifices to provide an intended back pressure to produce the oil through the upper tubing to the surface, large enough to discharge the water into a disposal zone, and placed at a low enough depth to allow the second vertical length of the casing to gravity separate the oil and the water.

6. The method of claim 5 wherein the pump comprises an electric submersible pump.

7. The method of claim 5 wherein the pump comprises a modified plunger rod pump.

8. The method of claim 5 wherein the pump comprises a progressive cavity pump.

* * * * *